US005761982A

United States Patent [19]

Abt et al.

[11] Patent Number: 5,761,982

[45] Date of Patent: Jun. 9, 1998

[54] PERFORATING AND CUTTING DEVICE AND PROCESS FOR PRODUCING A SHEET OF INDIVIDUALLY SEVERABLE AND RELEASABLE STAMPS

[75] Inventors: Richard B. Abt, Branford; Richard J. Brining, Old Lyme; William G. Gunther, Guilford, all of Conn.

[73] Assignee: George Schmitt & Co., Branford, Conn.

[21] Appl. No.: 670,771

[22] Filed: Jun. 20, 1996

[51] Int. Cl.[6] ..... B26D 9/00

[52] U.S. Cl. ..... 83/861; 83/863; 83/864

[58] Field of Search ..... 83/861, 862, 863, 83/864, 865, 343, 346, 663, 669, 697, 684, 679

[56] References Cited

U.S. PATENT DOCUMENTS

| | | | |
|---|---|---|---|
| 2,598,649 | 5/1952 | Rintoul | 83/663 |
| 2,751,005 | 6/1956 | Parmer | 83/865 |
| 2,771,534 | 11/1956 | Schwahn | 83/343 |
| 3,138,985 | 6/1964 | Mills . | |
| 3,485,146 | 12/1969 | Sarka | 83/343 |
| 3,522,762 | 8/1970 | Sauer . | |
| 3,611,500 | 10/1971 | Carrigan et al. . | |
| 3,677,122 | 7/1972 | Rautine . | |
| 3,850,059 | 11/1974 | Kang | 83/669 |
| 3,866,497 | 2/1975 | Wolfburg et al. | 83/343 |
| 4,016,786 | 4/1977 | Korner | 83/863 |
| 4,020,725 | 5/1977 | Climo | 83/669 |
| 4,248,117 | 2/1981 | Bugnone | 83/863 |
| 4,825,739 | 5/1989 | Pfaff . | |
| 4,934,231 | 6/1990 | Chesnut et al. . | |
| 5,176,613 | 1/1993 | Calvin et al. | 83/862 |
| 5,370,028 | 12/1994 | Grebe | 83/684 |
| 5,488,889 | 2/1996 | Kang | 83/669 |
| 5,582,571 | 12/1996 | Simpson et al. | 83/862 |

FOREIGN PATENT DOCUMENTS

| | | |
|---|---|---|
| 1122465 | 8/1968 | United Kingdom . |

*Primary Examiner*—Maurina T. Rachuba

*Attorney, Agent, or Firm*—St. Onge Steward Johnston & Reens LLC

[57] ABSTRACT

An apparatus and method is provided for simultaneously perforating and cutting a lithe sheet material having multiple layers containing at least an upper and lower layer, comprising a knife die having a cutting edge, wherein the cutting edge is contained in the same plane, and an anvil die located opposite the knife die, wherein the surface of the anvil die contains a pattern of cavities which corresponds to the locations where primarily only the upper layer of the material is cut completely through and protrusions of the anvil primarily correspond to the locations where the entire thickness of the material is cut along the same line as the cut through the upper layer. A sheet material of removable shapes is also provided comprising an upper layer having a printed side and a self adhesive side, and a lower layer having a release surface adjacent the upper layer's self adhesive side, wherein a shape has been completely cut out of the upper layer so that the shape can be pealed from the lower layer and the lower layer has been perforated through its thickness along all or part of the same lines as the cut shape so that the lower layer can either be kept in whole or torn along the perforation.

1 Claim, 5 Drawing Sheets

PERFORATING AND CUTTING DEVICE AND PROCESS FOR PRODUCING A SHEET OF INDIVIDUALLY SEVERABLE AND RELEASABLE STAMPS

FIELD OF THE INVENTION

The invention relates to a cutting device and process, more specifically to a cutting device that both cuts a shape, such as a stamp or ticket, part way through the thickness of a sheet material and also simultaneously perforates along the continuously cut pattern using a cutting edge where the entire tip portion is maintained in a plane. More particularly, the present invention relates to a device and process for producing a sheet of stamps or tickets that are individually releasable from a backing sheet or that can be separated in groups of stamps or tickets.

BACKGROUND OF THE INVENTION

Postage stamps and tickets are produced in sheets having multiple stamps or tickets. The stamps or tickets have a self-stick adhesive applied to one side thereof and are adhered to a backing material which has a release surface on one side of it. The stamps or tickets can be individually removed from the backing sheet and placed on an envelope or other surface. However, if there is a large number of stamps or tickets arranged in a grid on a backing material, it is difficult to separate the stamps from each other on an individual or group basis so that the stamps can be subsequently removed from the backing material for application to an envelope or other surface. Thus, if a grid of fifty stamps, having five stamps to a row and ten stamps to a column, were provided, and it was desired to separate the stamps into two groups prior to using them, it would be extremely difficult, if not impossible, to cut the underlying backing sheet with scissors to sever the stamps individually or into groups, especially when the stamps have contoured edges that simulate round hole perforations as is the case with conventional postage stamps.

The aforementioned sheets of stamps or tickets are manufactured by placing a sheet of printed material having a substantially uniform thickness and having a layer of self-stick adhesive applied to a side thereof, onto a sheet of backing material having a release surface on one side thereof. The backing material and the printed material are placed between an anvil and a knife to cut the sheet of printed material to a predetermined and constant depth so that the stamps or tickets are individually removable. However, because the underlying backing material is not cut, the stamps or tickets can not be separated individually or in groups prior to removal from the backing material.

Another method used to manufacture sheets of tickets or stamps is to perforate a sheet having a single thickness. When a group of stamps, tickets or other shapes are perforated in a single sheet of paper, the perforations are made by removing tiny cylindrical segments of paper material, thus leaving a line of holes in the paper. The paper may then be torn along the line of holes, thus separating the stamps or tickets individually. In the case of stamps, the stamps are then wetted and applied to an envelope. It would be desirable to provide a way of separating stamps or tickets from envelope. It would be desirable to provide a way of separating stamps or tickets from a sheet of paper without providing visible perforation holes along the perforation line.

Thus, it would be desirable to perforate the sheet of backing material so that individual self-adhesive stamps or tickets could be separated either individually or in groups from the other stamps or tickets, so that they may then be subsequently removed from the backing material and applied to an envelope or other surface.

Cutting devices which either cut completely through or perforate a sheet or web material are known in the art and include a variety of features to keep the cut items attached to the web material until a later stage in the processing or to merely weaken the material in locations to be later torn or folded along the weakened edge.

U.S. Pat. No. 3,138,985 to Mills discloses perforating plastic films with a non-continuous knife edge situated in a non-moving anvil portion. The plastic film is advanced in sections and a roller advances over the plastic film to cut two holes in the film at each end of the knife edge. The knife edge weakens the material in the area directly over the knife edge to control the direction that the film severs between the two holes, thus, creating a perforation in the plastic film.

U.S. Pat. No. 3,611,500 to Carrigan et al. discloses a machine that molds and cuts shapes out of a web sheet material. A knife both seals and cuts the edges of the desired shape. Recesses in an anvil allow sections along the shape's edge to be compressed into a tab which holds the formed article in the web sheet matrix until a later point in the processing.

U.S. Pat. No. 4,934,231 to Chesnut et al. discloses a rotary die-cutting device which uses two rollers to cut shapes from a sheet material. The device both cuts desired edges in the material and weakens the material in desired location to facilitate folding of the cut out shape.

None of the prior art devices teach cutting through only a portion of the sheet material while simultaneously perforating through the entire thickness of the sheet material.

What is desired, therefore, is an apparatus for cutting sheet material which cuts a portion of the way through the thickness of the material in a continuous cut while simultaneously perforating the material with a continuous cutting edge having its entire tip portion contained in the same plane.

SUMMARY OF THE INVENTION

Accordingly, it is an object of the invention to completely cut a desired shape through a portion of the thickness of a sheet material while simultaneously perforating, along the cut edge, either a greater depth of the thickness of the sheet material or the entire thickness of the sheet material.

A further object of the invention is to use a bi-layer sheet material so that the upper layer is completely cut to enable a shape, such as a stamp or ticket, to be removed from the upper layer, leaving the lower layer intact, and the lower layer is perforated so that the sheet material can be completely severed along the cut line.

Still another object of the current invention is to create an article of a bi-layer, lithe sheet material having an upper layer of an adhesive material and a lower layer of a backing material, where a shape, such as a stamp or ticket, has been completely cut out of an upper layer so that the shape can be peeled from the backing material and the backing material has been perforated along all or part of the same lines as the cut shape so that the backing material can either be kept in whole or torn along the perforation.

These and other objects are achieved by provision of a knife die with a cutting edge in which the tip portion is contained in a plane, an anvil die with a pattern of cavities and protrusions located opposite the knife die, and a lithe sheet material positioned between the two dies. The material is placed between the two dies and pressure is applied by the dies on the sheet material in the area where the sheet material contacts both dies. The cutting edge forces the sheet material to deform into the cavities so that the cutting edge penetrates only a portion of the thickness of the sheet material in the area adjacent the cavities and penetrates a greater depth (or the entire thickness) in the areas adjacent the protrusions. This creates a shape that is completely and continuously cut to a certain depth, and a perforation to a greater depth along that cut.

In accordance with one aspect of the invention, the sheet material comprises multiple layers, and the two dies are pressed together so that only the desired layers are completely cut and the desired layers perforated.

In another aspect of the invention a sheet of stamps, tickets or other shapes is produced in which the shape has been completely cut out of an upper sheet material, which may be printed on its upper surface and coated with self-adhesive on its lower surface, and a lower sheet, which is coated on its upper surface to release the stamps or tickets, has been perforated along the same line as the continuous cut. Preferably, the lowest edge of the cut through the sheet material is a continuous line that is completely contained in the lower layer, undulating between the upper surface and the lower surface of the lower layer.

In accordance with another aspect of the invention, a sheet of single thickness material is simultaneously cut and perforated so that perforation holes are not visible. In accordance with this aspect of the invention, the single sheet of material is placed between two dies and pressure is applied by the dies on the sheet material in the area where the sheet material contacts both dies. The cutting edge forces the sheet material to deform into cavities so that the cutting edge penetrates only a portion of the thickness of the sheet material and penetrates a greater depth (or the entire thickness) in the areas adjacent to the protrusions on the die. This creates a complete and continuous cut to a certain depth and a perforation along that cut to a greater depth. The single sheet of material, such as a sheet of stamps or tickets, can be torn along the cut.

The invention and its particular features and advantages will become more apparent from the following detailed description considered with reference to the accompanying drawings.

DETAILED DESCRIPTION OF THE INVENTION

Figure 1:
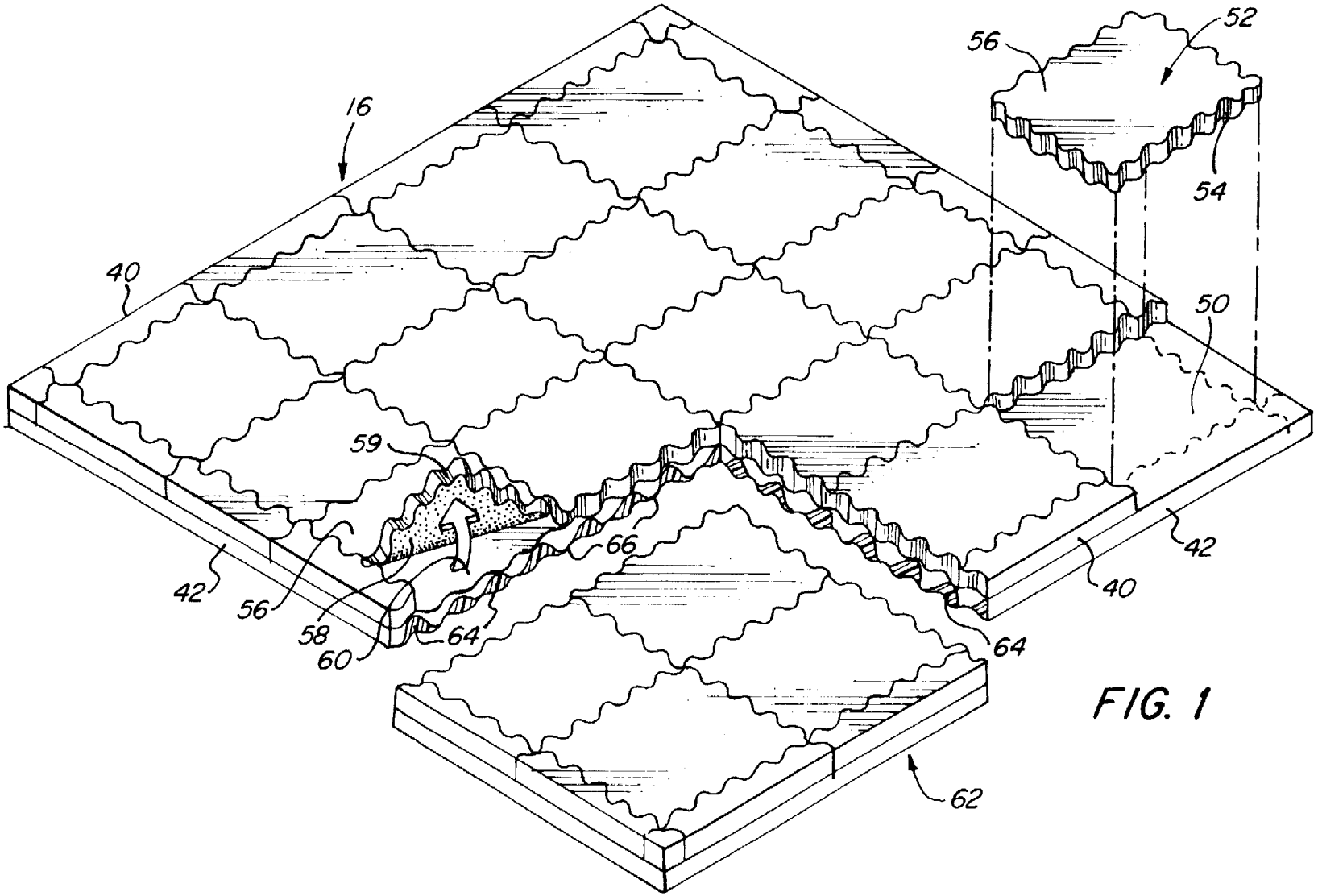
FIG. 1 is a perspective view of a sheet of stamps or tickets made in accordance with the present invention, with a group of stamps separated from the sheet, one stamp removed from the sheet and another stamp partially removed.

Referring to FIG. 1, a perspective view of a sheet of removable shapes, such as stamps or tickets, is shown. The sheet includes an upper layer 40 and a lower layer 42. The upper layer 40 is typically paper, but may also be plastic or other sheet material. The lower layer 42 is preferably a backing material such as paper having a release surface 50 on one side thereof. The release surface 50 can be made of silicon or other commonly used release surfaces. The release surface 50 permits the shape 52 to be removed from the lower layer 42. Shape 52 can be a postage stamp, a pass, a credential, an identifying stamp, a sticker and the like. The shape 52 is cut from layer 40 so that its entire periphery 54 is severed from the remainder of layer 40. In accordance with one aspect of the invention, layer 40 is a printable paper or plastic material that has printing on a first side 56 and an adhesive layer 58 on the other side. As shown by arrow 60, the shape 52 can be pulled upwardly and separated from the remainder of upper layer 40. On the right side of FIG. 1, a shape has been completely removed from layer 40. In the case of a postage stamp, a person utilizing the sheet material would simply peel back a stamp as shown in the direction of arrow 60, remove the stamp and place it on an envelope. The remaining stamps would remain adhered to the release surface 50 of layer 42 and would be available for use at a later time.

It is desirable to be able to separate one or a group of shapes 52 prior to the removal of the shapes from the backing sheet 42. In the case of a postage stamp, it is often desirable for the post office or a store to be able to sell one or a group of stamps from a complete sheet of stamps. Referring to FIG. 1, a section 62 of sheet 16 is removed from the remainder of the sheet 16 prior to the shapes 52 being removed from release layer 50. In the case of a postage stamp, the post office may sell the four stamps 62 for use by the customer at a later date. In the case of the distribution of tickets to a sporting event, the tickets can be sold to the user and can be removed from the backing layer 42 at a later time, and the ticket applied to the clothing of the user to show that an attendance fee has been paid. As shown in FIG. 1, when the group of stamps or other shapes is separated from the sheet 16, the backing sheet 42 is torn at a plurality of areas 64 as indicated by crosshatching in the drawing. Thus, each of the shapes 52 is completely removable from the backing sheet 42, and the upper layer 40 has been completely cut so that the shape 52 can be peeled away from the lower layer 42, and the lower layer 42 has been cut along the same line as the cut shape 52 but to a depth which varies along the length of the cut. As will be described in detail subsequently, the cut preferably undulates along a continuous path to provide a series of perforations 66. The perforations 66 preferably extend through the entire thickness of layer 42. However, it is possible for layer 42 to be partially cut. The partial cut weakens the layer 42 so that it can be torn along the line of the cut to permit removal of a portion 62 of the sheet 16.

Figure 2:
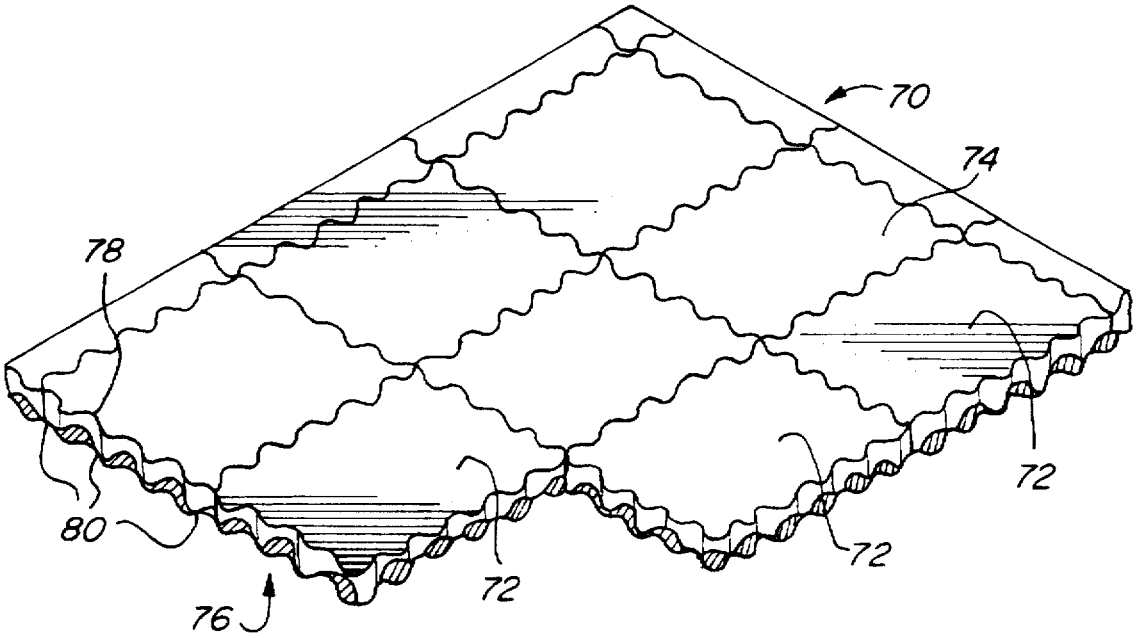
FIG. 2 is a perspective view of a series of stamps or tickets in a sheet having a single layer, wherein one of the stamps has been separated from the rest of the sheet.

Referring to FIG. 2, another embodiment of a sheet in accordance with the present invention is shown. Sheet 70 is a single layer sheet of material such as paper or plastic. The sheet 70 has a group of cut shapes 72 that are partially cut out from sheet 70. In the case of postage stamps, sheet 70 would be printed on one side 74 and have a wettable adhesive on the under side 76. A discrete stamp and/or group of stamps can be separated from the remainder of the sheet. Thus, the sheet provides the same function as conventional perforations, but the use of perforation holes is avoided.

In the case of a post office, the post office can sell discrete groups of stamps. As shown in FIG. 2, a number of shapes 72 have been removed from the sheet 70 by tearing the shapes 72 away from the sheet 70. The sheet 70 is cut along cut 78 to a depth which varies and undulates along the length of the cut 78. More specifically, at a series of points 80 along the cut 78, the depth of the cut 78 is completely through the thickness of the sheet 70, thus completely perforating the sheet 70. The top surface 74 of the sheet 70 is completely cut to a predetermined depth. The depth of the cut 78 preferably undulates along the length of the cut 78 to produce a perforation line that enables the discrete stamps or other shapes 72 to be removed from sheet 70.

The method of making and the apparatus for making the sheets 16 and 70 shown in FIGS. 1 and 2 will now be described with respect to the remaining figures of the application.

Referring to FIGS. 3 through 14, an apparatus having a cutting edge where the tip of the entire cutting edge is in a plane and an anvil containing cavities constructed in accordance with the invention, is shown and generally designated by the reference numeral 10. It should be noted that for the sake of clarity all the components and parts of device 10 may not be shown and/or marked in all the drawings. Also, as used in this description, the terms "up," "down," "upper," and "lower" refer to device 10 when in the orientation illustrated in FIGS. 9 and 10.

Although this description is written in terms of a cutting device, more specifically a stamp cutting device, for cutting out a self-adhesive shape from an upper layer and perforating a releasable lower layer, such description is for convenience only. It should be understood that the present invention applies to any cutting device where a sheet material is to be completely cut to a certain depth and perforated to a greater depth along the cut line. Additionally, the term perforation is used to signify any slit or hole created along any plane perpendicular to the plane of the sheet material. This means that the perforation may have occurred either through the entire thickness of the sheet material or through only a portion of the thickness provided the perforation either completely pierces the material or weakens it.

Figure 3:
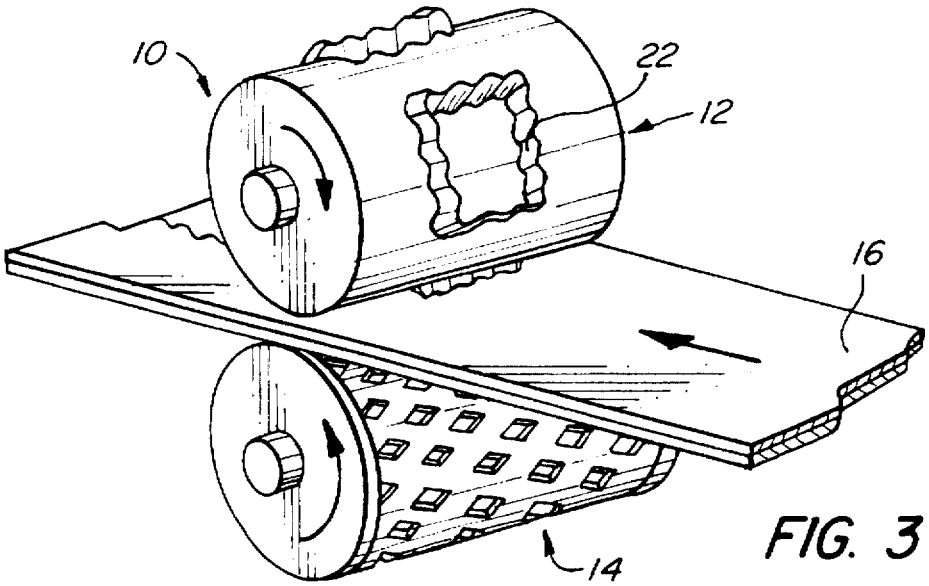
FIG. 3 is a perspective view of a roller knife die and anvil die in accordance with the invention to illustrate the placement of the dies and sheet material with respect to one another.
Figure 4:
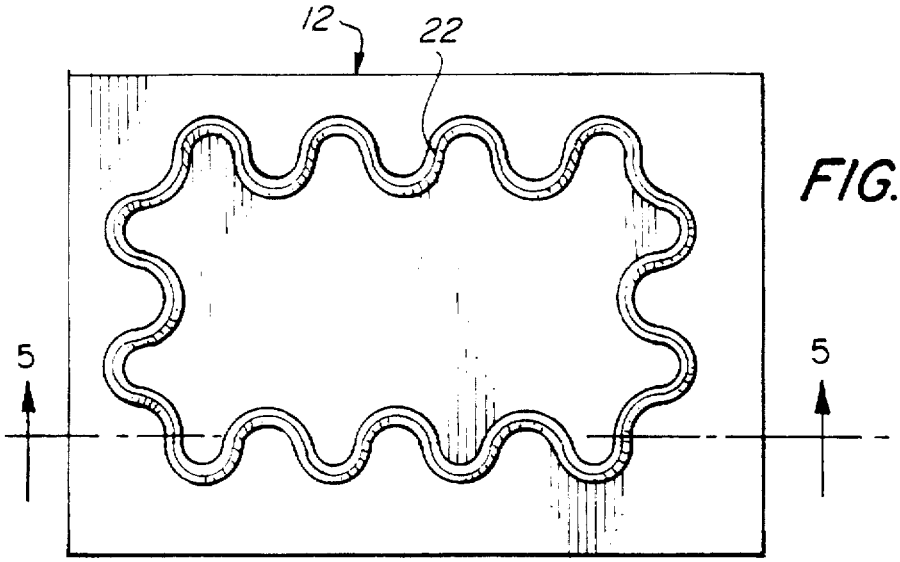
FIG. 4 is a top view of a knife die in accordance with another embodiment of the invention.
Figure 5:
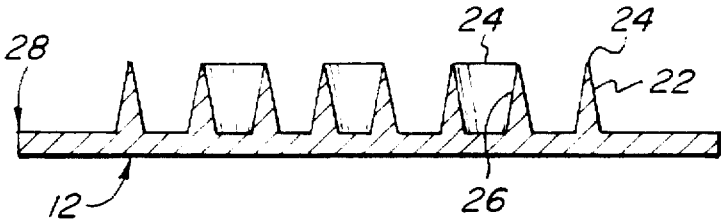
FIG. 5 is a cross-sectional view along the line 5—5 of the knife die in FIG. 4.

As illustrated in FIG. 3, cutting device 10 comprises a knife die 12 and an anvil die 14. Although the dies are illustrated in FIG. 3 as two roller dies, the dies can be in any form sufficient to enable the cutting/perforating operation as described herein. For example, the dies could both be in a plate form as illustrated in FIGS. 4 & 5. Further, one die could be in a roller form, and one die in a plate form where the roller die rotates and moves forward across the surface of the sheet material opposite the plate die. These are illustrative embodiments only and one of ordinary skill in the art may employ any form of a die as commonly known in the art.

Knife die 12 as illustrated in FIGS. 3, 4 & 5 comprises a continuous cutting edge 22. Typically cutting edge 22 is made of hardened steel. However, it is recognized that the skilled artisan could employ any material which could withstand the continuous cutting and pressure, while maintaining a sufficient cutting edge. Cutting edge 22 can be in any shape which allows the tip of cutting edge 24 to penetrate a sheet material 16. FIGS. 3 & 4 illustrate one form of a cutting edge 22 shaped in a triangular form where the sides of cutting edge 26 slope in to meet and form the tip of cutting edge 24. The shape of cutting edge 22 employed is not critical so long the tip of cutting edge 24 is contained in a plane as it applies pressure to an anvil die 14. FIG. 5 is a sectional view of knife die 12 which illustrates that the entire tip of cutting edge 24 is in a plane. Although the success of this invention does not require cutting edge 22 to be a continuous edge, in order to be able to remove a cut shape, such as a stamp or ticket, from the upper layer of sheet material 40, tip of cutting edge 24 defines the entire periphery of the shape 52. If however, the removal of a cut shape is not desired, a non-continuous tip of cutting edge 24 would also create the combined cutting and perforating operation of the current invention.

Figure 6:
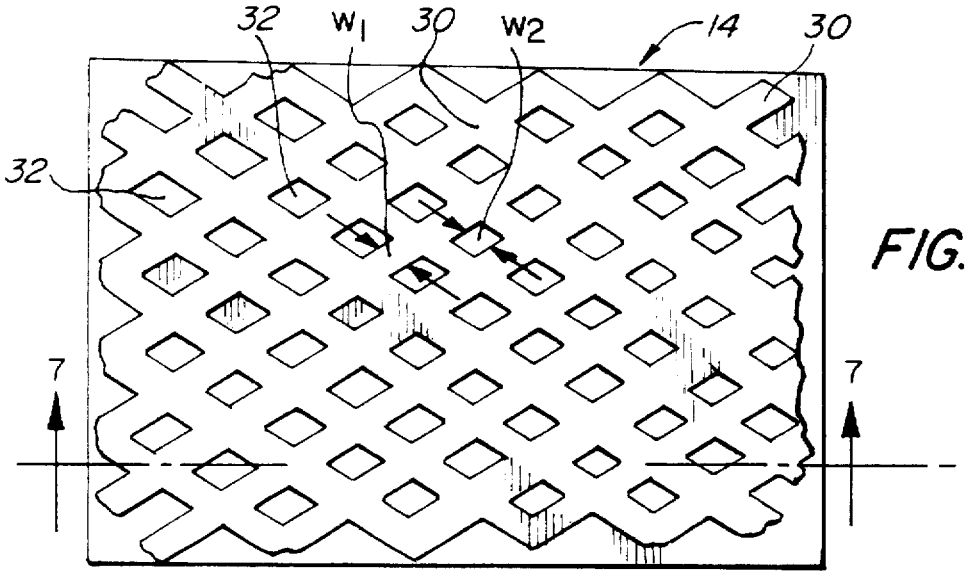
FIG. 6 is a top view of an anvil die to be used with the knife die shown in FIGS. 4 and 5.
Figure 7:
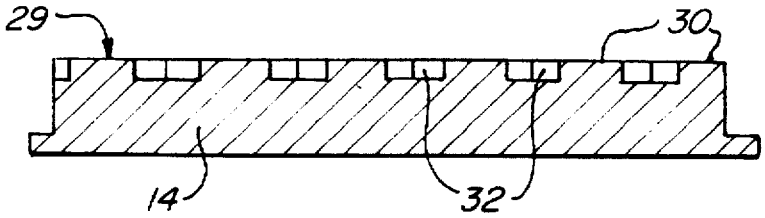
FIG. 7 is a cross-sectional view along the line 7—7 of the anvil die in FIG. 6 to illustrate the cavities and protrusions in the anvil die in accordance with the invention.

Anvil die 14 is illustrated in FIGS. 3, 6 & 7 and contains both protrusions 30 and cavities 32. The pattern made up of protrusions 30 and cavities 32 can be any which creates the desired amount of perforation while providing a sufficiently firm surface to allow cutting edge 22 to penetrate sheet material 16 to the desired depth. FIG. 6 illustrates one preferred anvil pattern where protrusions 30 define a criss-cross pattern. The pattern in FIG. 6 is significantly enlarged for illustration purposes. A typical anvil pattern would contain protrusions 30 having a width ($W_1$) of approximately 0.005 inch to .020 inch. A typical width ($W_2$) of cavities 32 is approximately 0.002 inch to .015 inch. Any pattern, spacing or height of protrusion 30 however, can be employed by the skilled artisan to create the desired amount of perforation in sheet material 16 while providing desired support to cut with cutting edge 22. A bi-level anvil can be produced by a variety of methods including etching or electrical or mechanical machinery. Referring the FIGS. 6 and 7, the anvil die 14 has a planar surface 29. A plurality of cavities 32 are formed in surface 29. As shows in FIGS. 9 through 11, the cavities are in random alignment with the cutting edge 22 on the knife die 12. The dies are moved relative to each other to force the cutting edge 22 against the sheet material 16 to cut the sheet material 16 adjacent the segments 30 to a first depth 17 and to deform the sheet material 16 into the cavities 32 and to cut the sheet material 16 adjacent to the cavities 32 to a second and variable depth 19, the second depth 19 being less than the first depth 17. As shown particularly well in FIGS. 9 and 10, the sheet material 16 has a thickness 21 that is completely cut in the areas adjacent the segments 30 and partially cut in the areas adjacent the cavities 32.

Anvil die 14 can be made of any material which can withstand repeated abrasion by cutting edge 22 and the stresses of the pressure applied to both dies in the direction of sheet material 16. Preferably, anvil die 14 is made of steel.

Sheet material 16 is a lithe sheet material that is able to flex under the pressure of the two dies. Typically sheet material 16 will be composed of more than one layer and may be any number of layers required for a desired application. Although any type of sheet material that is sufficiently flexible to accommodate the cutting and perforating operation of the current invention is within the scope of the invention, the preferred types of sheet materials are those that are used to create self adhesive stamp sheets. Preferably, sheet material 16 will be composed of two layers where the upper layer 40 is printable on its upper surface and is self adhesive on its lower surface. By self adhesive, any type of adhesive known to one of ordinary skill in the art is meant, including, but not limited to, permanent and releasable types. The adhesive may be applied to all or a portion of the surface of printable layer 40. The upper layer is typically made from paper and is approximately .001 inch to 0.005 inch thick. Lower layer 42 is a backing material having a release surface 50 to allow upper sheet 40 to be pealed off of lower layer 42. A typical lower layer 42 is paper or plastic and is approximately 0.001 inch to 0.010 inch thick.

For purposes of description here, the invention will generally be described with reference to a bi-layer sheet material 16 having an upper layer 40 and a lower layer 42 for convenience and clarity only, and is not intended to limit the scope of the invention.

Figure 8:
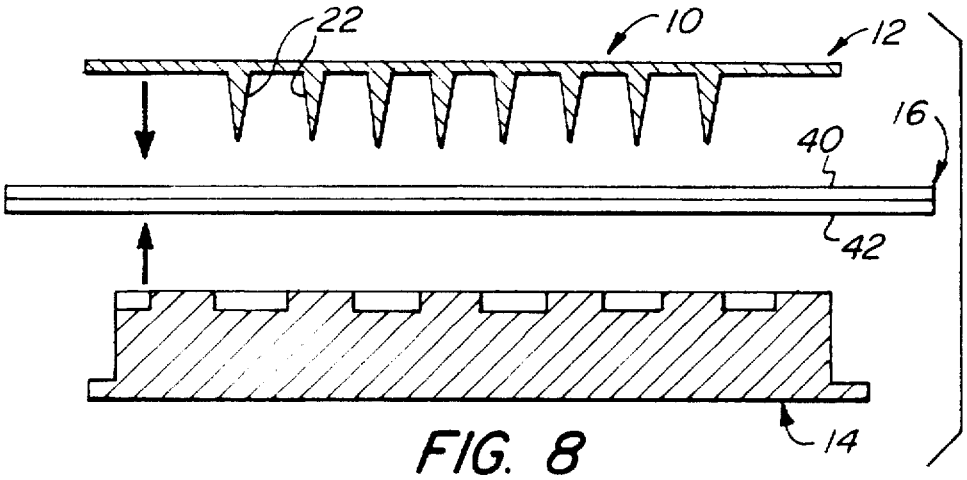
FIG. 8 is a cross-sectioned view of a knife die and an anvil die just prior to performing a cutting operation on a bi-layer, lithe sheet material.
Figure 9:
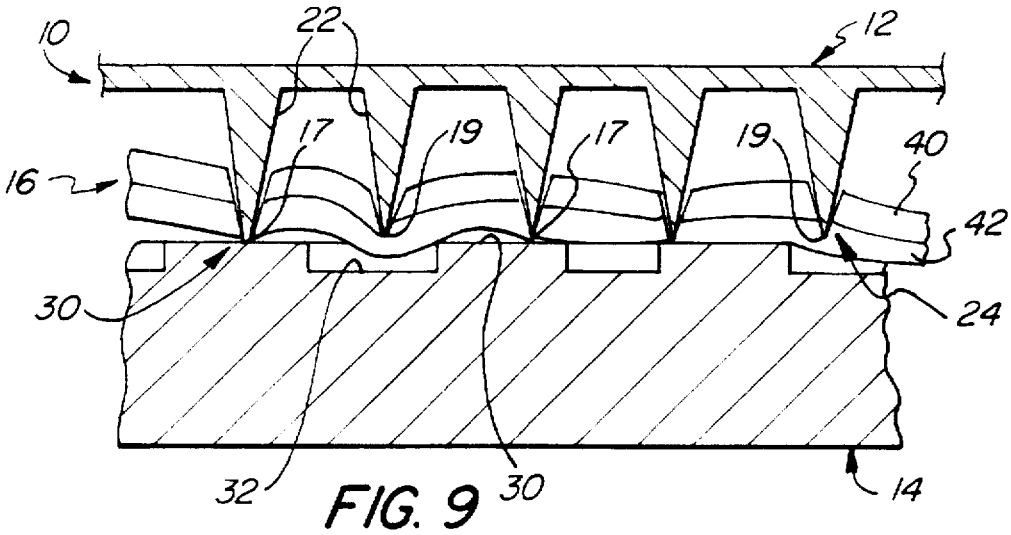
FIG. 9 is an enlarged sectional view of the interaction between the knife die and the anvil die with a bi-layer, lithe sheet material shown in FIG. 8.
Figure 10:
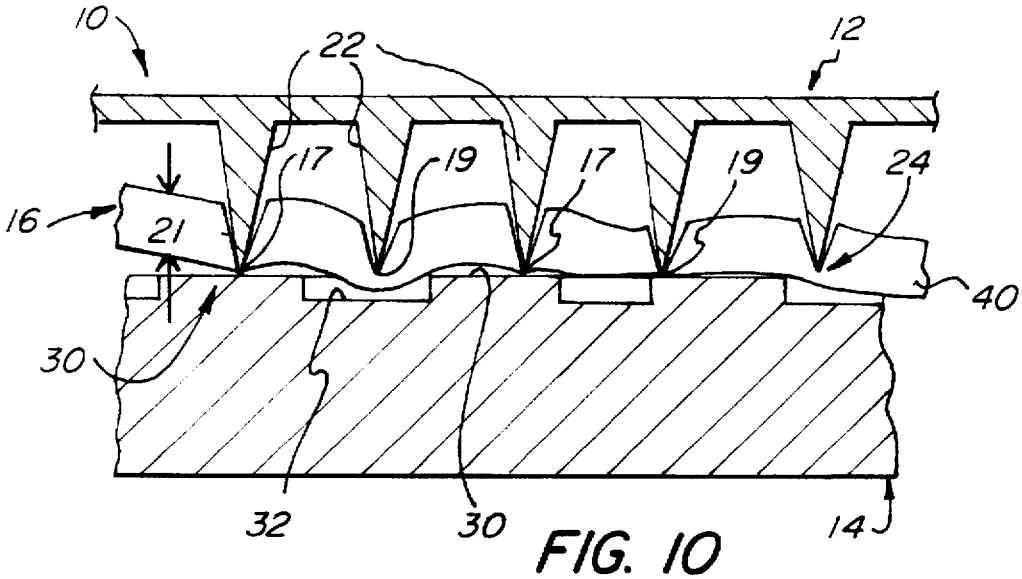
FIG. 10 is an enlarged sectional view of the interaction between the knife die and the anvil die shown in FIG. 8 with a single layer, lithe sheet material, rather than a bi-layer.
Figure 11:
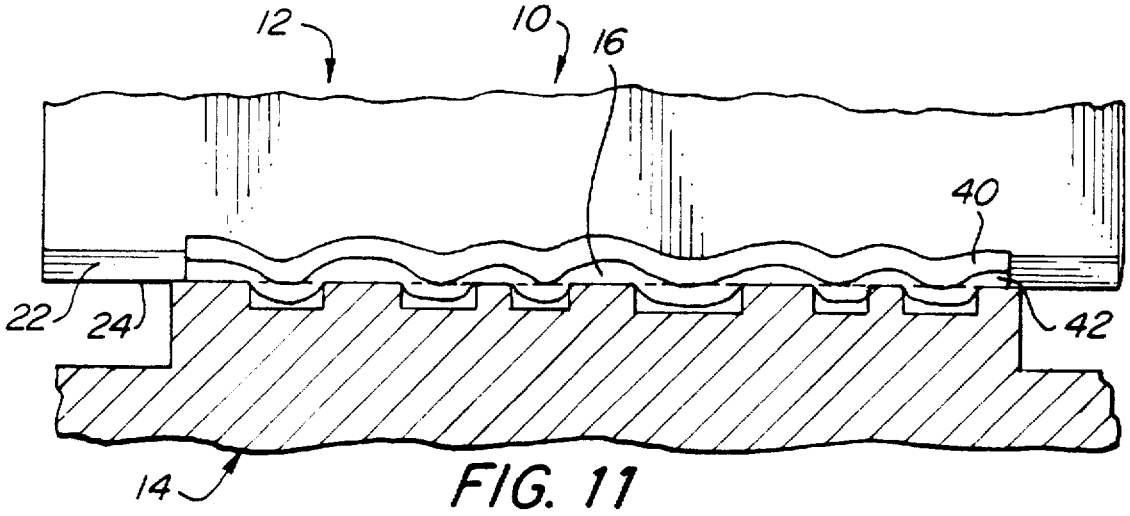
FIG. 11 is also an enlarged view of the interaction between a knife die and an anvil die with a bi-layer, lithe sheet material, taken along a straight edge of a knife die to illustrate the cutting and perforating operation in accordance with the invention.

Knife die 12 and anvil die 14 are positioned with respect to sheet material 16 such that sheet material 16 is between them in the area to be cut and perforated, as illustrated in FIGS. 3 & 8. FIG. 9 illustrates one embodiment of the cutting and perforating function of the current invention. Sufficient pressure in toward the planar surface of sheet material 16 is applied by both knife die 12 and anvil die 14 so that the interaction between the two dies allows knife die 12 to both penetrate and deform sheet material 16 when tip of cutting edge 24 is directly over a protrusion 30 and when directly over a cavity 32, respectively. This interaction causes upper layer 40 to be completely and continuously cut so that a shape 52 can be removed from the upper layer of sheet material 40 as illustrated in FIG. 1.

Figure 14:
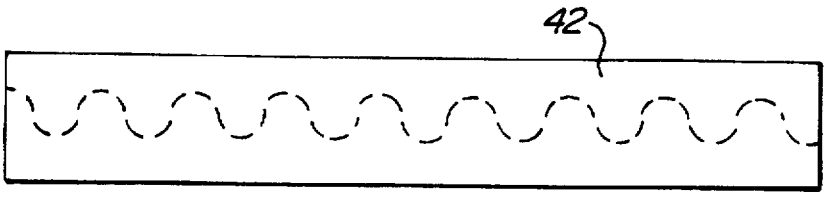
FIG. 14 is a view of the bottom of the sheet material in FIG. 13.

This interaction between cutting edge 22 and cavity 32 forces sheet material 16 to deform into cavity area 32 thereby preventing tip of cutting edge 24 from penetrating as great a depth of the sheet material 16 as it is able to when directly above a protrusion 30. This deformation causes lower layer 42 to be perforated as illustrated in FIG. 14. This perforation may penetrate the entire thickness of sheet material 16 or a lesser depth as required by a desired application.

When it is desired to create a sheet of self adhesive stamps a bi-layer sheet material comprising an upper layer 40 of self-adhesive paper would be employed in conjunction with a lower layer 42 of release backing paper. When sheet material 16 is fed between dies 12 & 14, sufficient pressure is applied on sheet material 16 so that the stamp shape is completely cut out of upper layer 40. Further the pressure is gauged so that the interaction between the pressure applied by dies 12 & 14, the spacing of protrusions 30 and cavities 32 in anvil die 14, and the flexibility of sheet material 16 is such that the cut sometimes completely penetrates the entire thickness of lower layer 42, and sometimes does not penetrate its entire thickness.

If it is desired to cut and perforate a sheet material 16 having more layers than two, the same inventive principles apply. The pressure, protrusion and cavity dimension, and sheet material type, interaction is gauged so that the desired number of layers are completely and continuously cut, the desired layers (lower than those cut) are perforated, and the desired layers (lower than those perforated) remain uncut.

Figure 12:
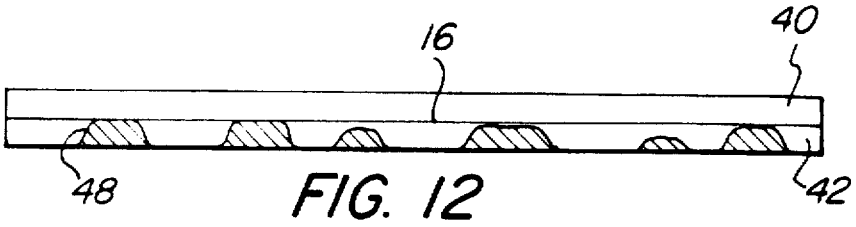
FIG. 12 is a cross-sectional view of the bi-layer, lithe sheet material along the non-linear cutting line in FIG. 9 after the cutting operation is completed, to illustrate the undulating path of the depth of the cut within the lower layer of the sheet material in accordance with the invention. The cross sectional view is also taken along the non-linear cutting line 12—12 of FIG. 13.
Figure 13:
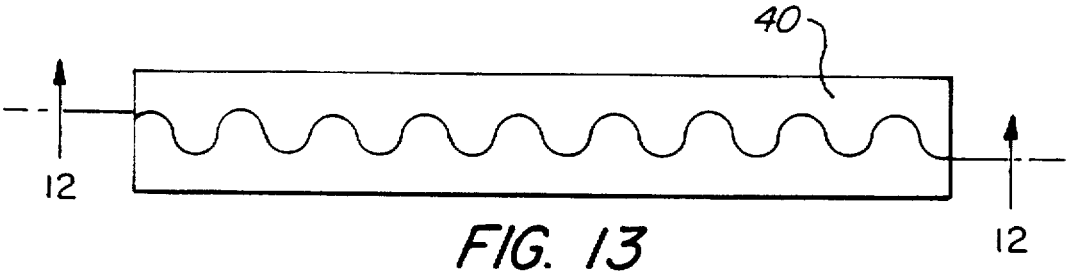
FIG. 13 is a view of the top of the sheet material in FIG. 12.

FIGS. 12–14 provide an optional viewpoint to further illustrate the type of cut that is generated by the interaction between a cutting edge 22 and a pattern of protrusions 30 and cavities 32 in an anvil die 14. FIG. 12 represents a linear cutting edge 22 for illustrative purposes. When the two dies apply sufficient pressure on the planar surfaces of sheet material 16, an undulating, unbroken cut line is created in the lower layer of sheet material 42 as illustrated in FIG. 13. The cut line undulates within the lower layer of sheet material 42 so that upper layer 40 is always cut completely through its entire thickness, as illustrated in FIG. 13, but lower layer 42 is perforated as illustrated in FIG. 14.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A process for forming a sheet of self-adhesive stamps wherein both the stamps are removable and the sheet can be severed in shapes of the stamps, comprising:

providing a knife die comprising a cutting edge having a tip entirely contained in a plane;

locating an anvil die comprising cavities and protrusions opposite the knife die;

positioning a bi-layer, lithe sheet material between the knife die and the anvil die, wherein the sheet material comprises an upper layer printable on one side and self-adhesive on the other and a lower layer having a release surface in contact with the self-adhesive of the upper layer;

applying sufficient pressure with the dies on the sheet material in the area where the sheet material contacts both dies; and whereby the cutting edge, the cavities, and the protrusions deform the sheet material down into the cavities, so that the cutting edge cuts through the upper layer in all places and the lower layer only in the areas adjacent a protrusion.

* * * * *